US006854989B2

(12) United States Patent
Milan

(10) Patent No.: US 6,854,989 B2
(45) Date of Patent: Feb. 15, 2005

(54) POP-OUT OUTLETS FOR HOUSINGS

(76) Inventor: Henry Milan, 1709 Apple Ridge Ct., Rochester Hills, MI (US) 48306

( * ) Notice: Subject to any disclaimer, the term of this patent is extended or adjusted under 35 U.S.C. 154(b) by 85 days.

(21) Appl. No.: 10/313,312

(22) Filed: Dec. 6, 2002

(65) Prior Publication Data

US 2003/0148644 A1 Aug. 7, 2003

Related U.S. Application Data

(60) Provisional application No. 60/338,299, filed on Dec. 6, 2001.

(51) Int. Cl.[7] ..... H01R 13/44
(52) U.S. Cl. ..... 439/131
(58) Field of Search ..... 439/131, 925, 439/650–654, 32, 33, 140; 174/57

(56) References Cited

U.S. PATENT DOCUMENTS

| | | | | | |
|---|---|---|---|---|---|
| 2,196,842 | A | * | 4/1940 | Strazzabosco | 439/131 |
| 5,575,668 | A | * | 11/1996 | Timmerman | 439/131 |
| 6,290,518 | B1 | * | 9/2001 | Byrne | 439/131 |
| 6,478,587 | B2 | * | 11/2002 | Sharples | 439/131 |
| 6,568,946 | B1 | * | 5/2003 | Chou | 439/131 |

* cited by examiner

*Primary Examiner*—Ross Gushi
(74) *Attorney, Agent, or Firm*—MacMillan, Sobanski & Todd, LLC

(57) ABSTRACT

A method and apparatus for selectively producing and/or providing additional pop-out or extendable outlets or connectors in electronic housing devices is shown.

35 Claims, 12 Drawing Sheets

POP-OUT OUTLETS FOR HOUSINGS

RELATED APPLICATION

This application is claiming benefit, under 35 U.S.C. § 119(e), of the provisional application filed Dec. 6, 2001, under 35 U.S.C. § 111(b), which was granted Ser. No. 60/338,299, and is hereby incorporated by reference.

BACKGROUND OF THE INVENTION

1. Field of the Invention

The present invention relates generally to housings, and more particularly to pop-out or pop-up outlets for electronics housings, and most particularly to pop-out or pop-up outlets for surge protection devices.

2. Discussion of the Related Art

Electrical outlets on electronics housings are well-known in the art. Surge protection devices are also well known in the electronics art as being desirable and/or necessary for protecting sensitive electronic devices from surges of current, whether over line cords, telephone lines, or other connections. A common problem with electronics housings and surge protection devices of all types is they never seem to have enough outlets to protect the desired number of devices.

The electronics housings and surge protectors known in the art generally have a fixed number of outlets or receptacles, or require modules to be added to provide additional outlets or receptacles. This may increase the size of the housing or the surge protection device, and may increase the overall cost of the housing or surge protection device. Thus, those skilled in the art have continued to search for ways to have additional outlets or receptacles present which do not take up space when not needed, and do not require the addition of modules or other devices to the basic housing or surge protector device.

SUMMARY OF THE INVENTION

The present invention solves the problems present in the art by providing pop-up, pop-out or otherwise extendable outlets for electronics housings and surge protection devices such as, for example, line cord surge protectors, telephone line surge line protectors, network surge protector's, co-ax surge protectors, and other types of surge protectors known in the art. With the pop-out outlets in their retracted position, the overall size of the device is not increased, and when the pop-out outlet is "popped-out" of the housing to expose additional outlets or connectors, only then is the size of the device increased, and without additional cost.

Thus, it would be advantageous to provide additional pop out outlets or connectors in an electronics housing or surge protection device.

Further advantages of the present invention will be apparent from the following description and appended claims, reference being made to the accompanying drawings forming a part of the specification, wherein like reference characters refer to corresponding parts in the several views.

BRIEF DISCRIPTION OF THE DRAWINGS

The above, as well as other advantages of the present invention, will become readily apparent to those skilled in the art from the following detailed description when considered in light of the accompanying drawings in which.

DESCRIPTIONS OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
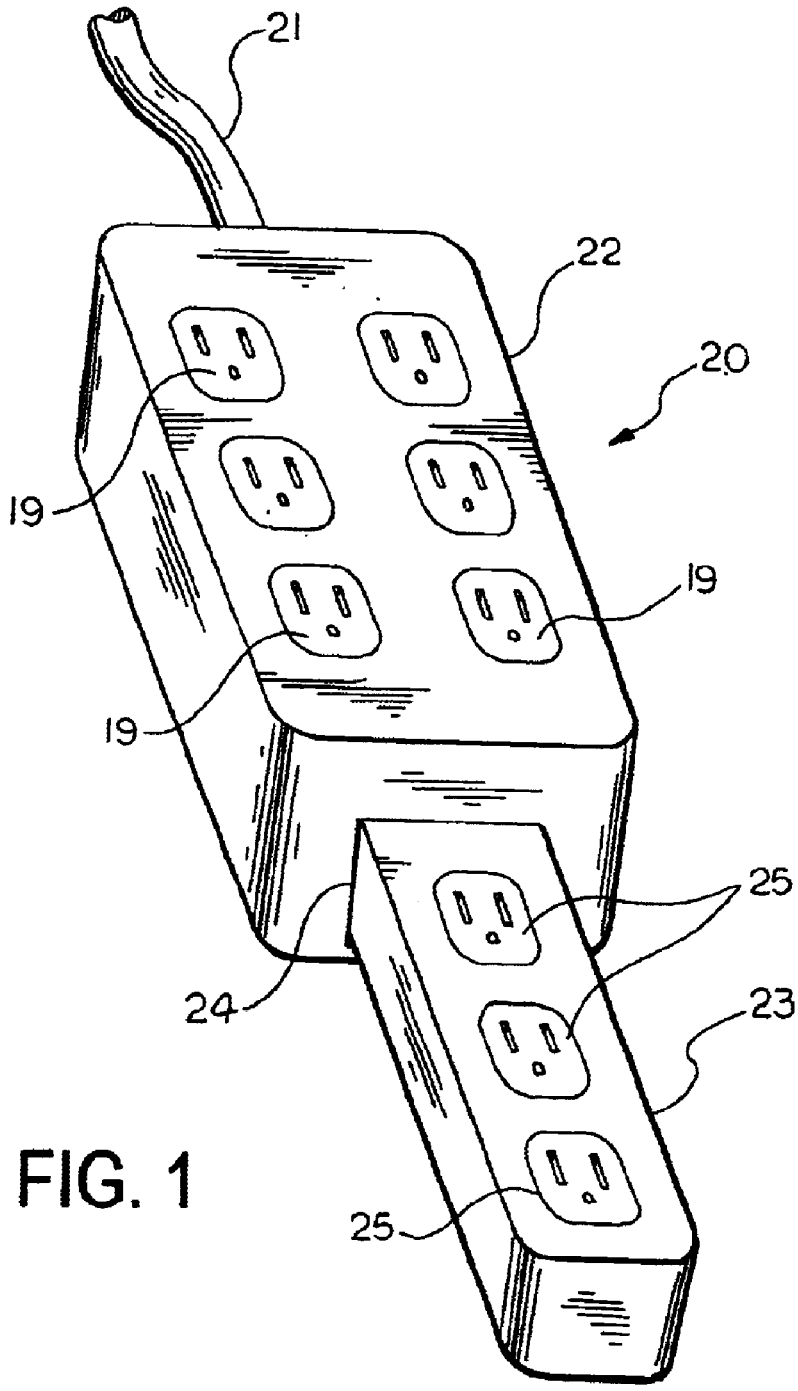
FIG. 1 is a perspective view of a construction embodying the present invention.

Referring now to FIG. 1, there is shown a surge protection or other electronic housing device, generally designated by the numeral 20, for example, for protecting devices connected to line current from electrical surges. There is shown a line cord 21, for connection to a source or power and a surge protector housing, 22, having a plurality of electrical outlets or connectors, 19, to receive a standard three prong line cord plug.

Figure 8:
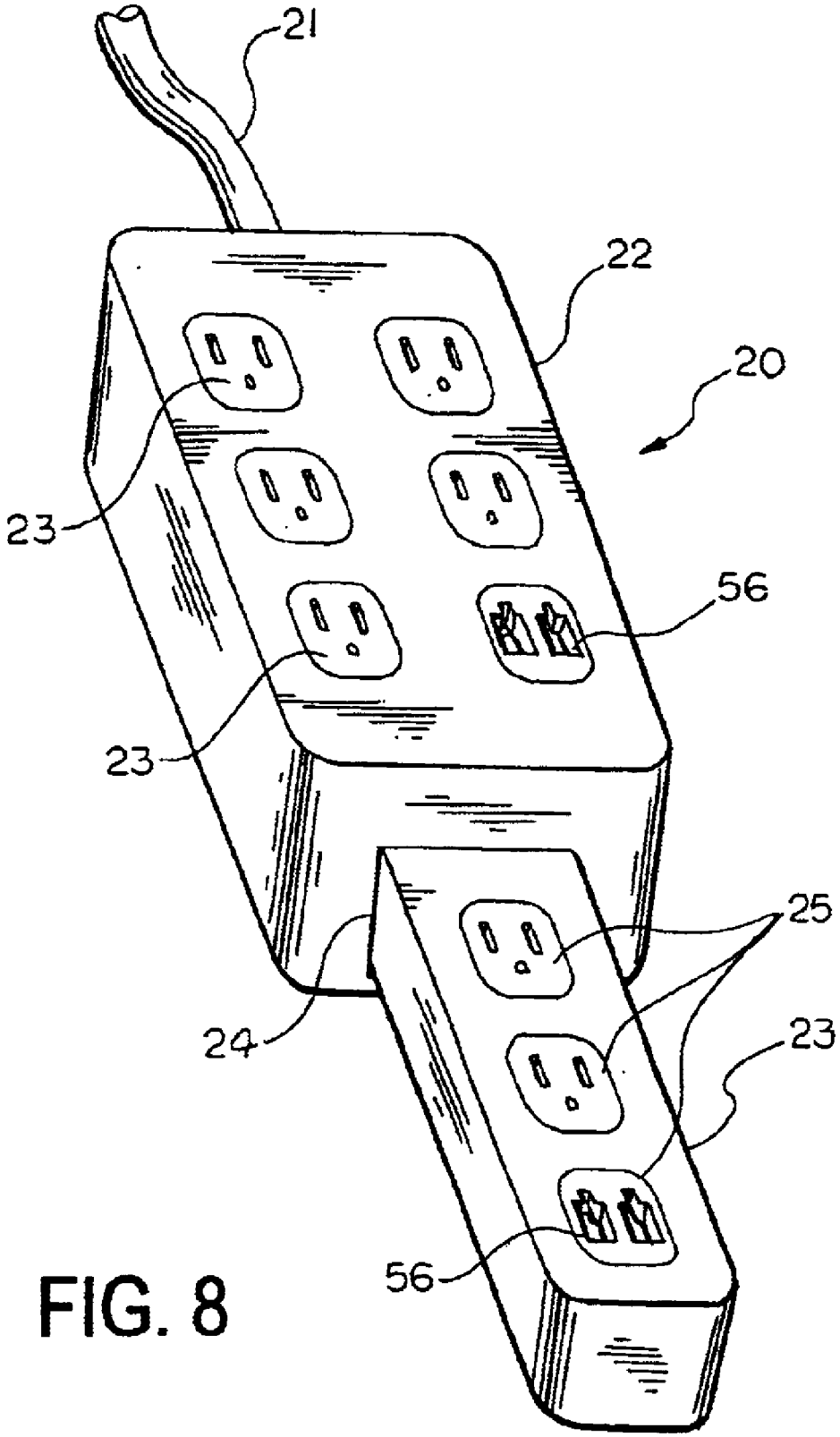
FIG. 8 is a perspective view of a construction embodying the present invention.
Figure 9:
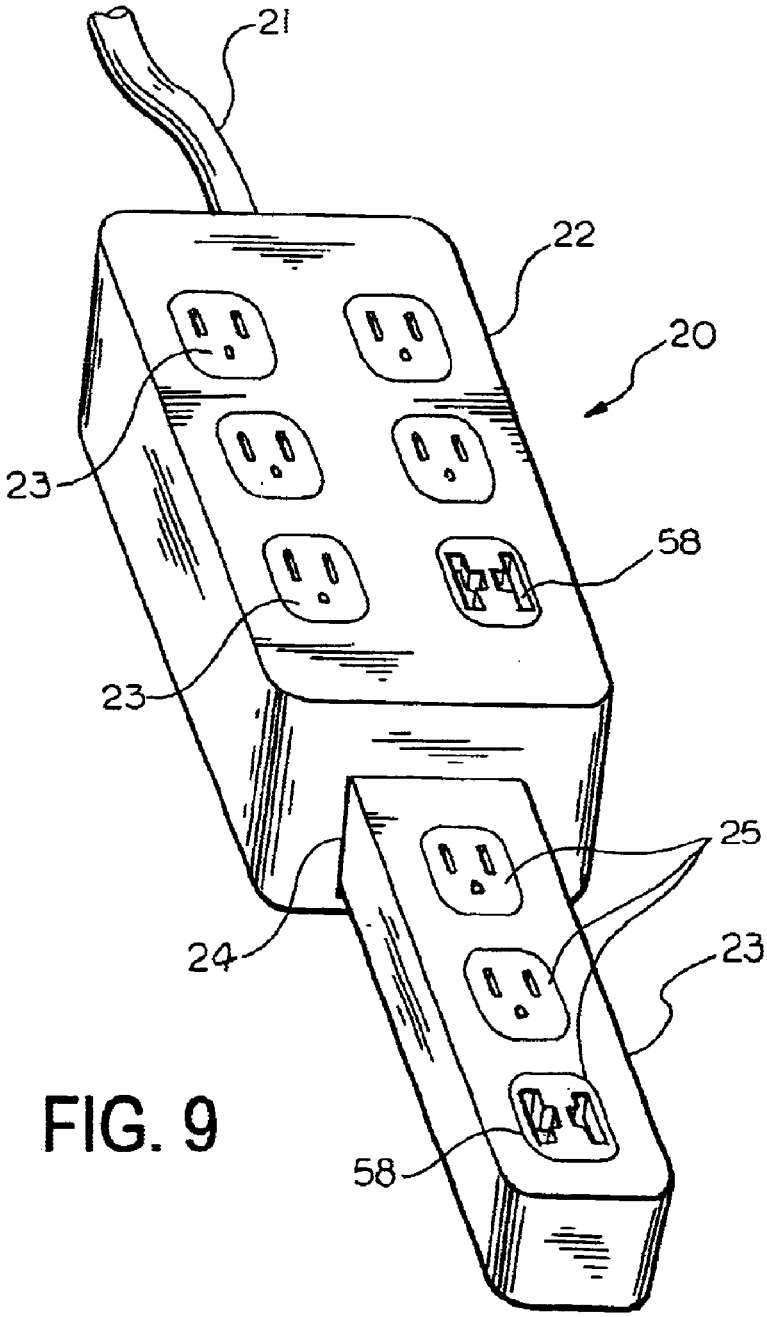
FIG. 9 is a perspective view of a construction embodying the present invention.
Figure 10:
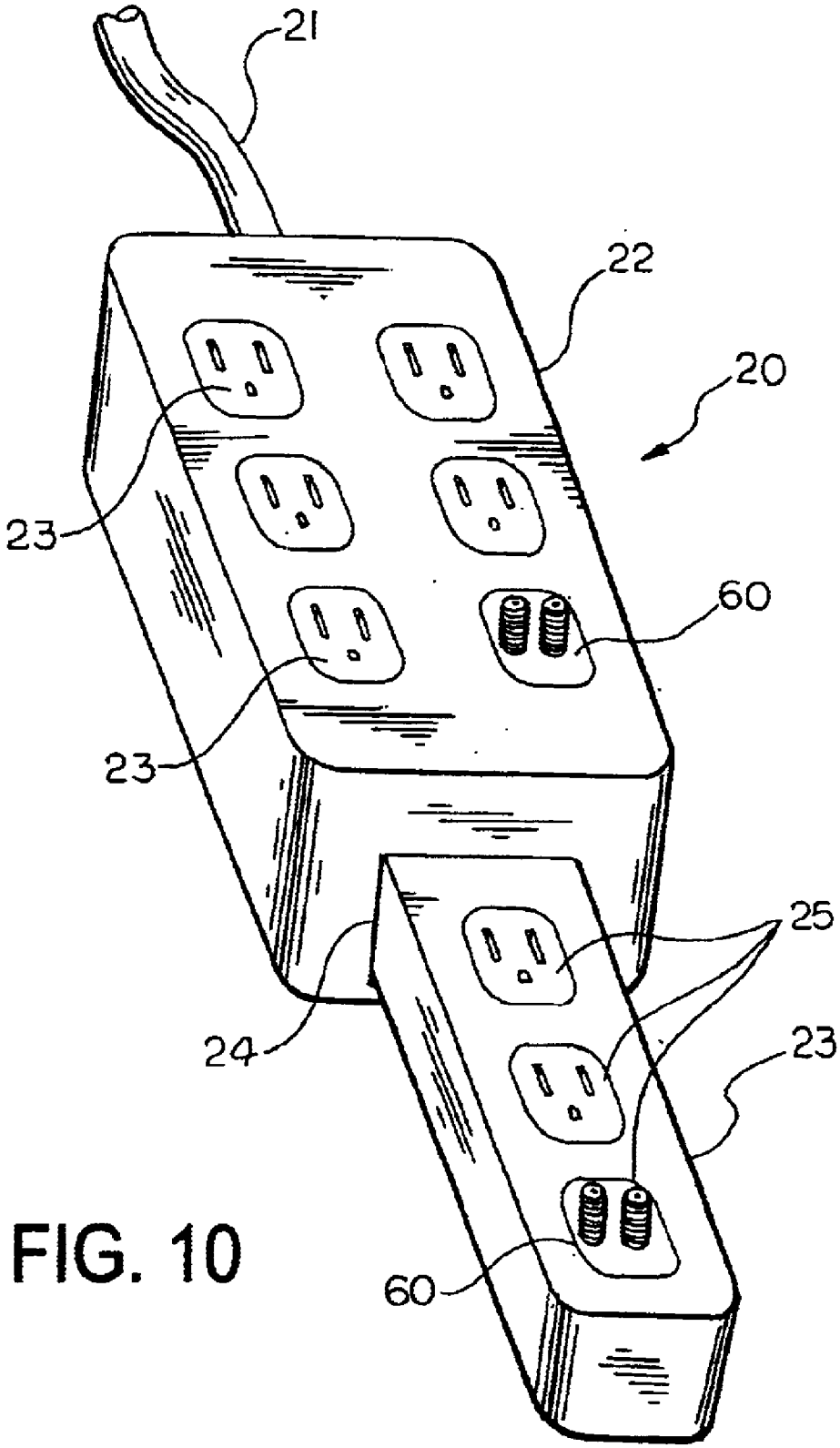
FIG. 10 is a perspective view of a construction embodying the present invention.
Figure 11:
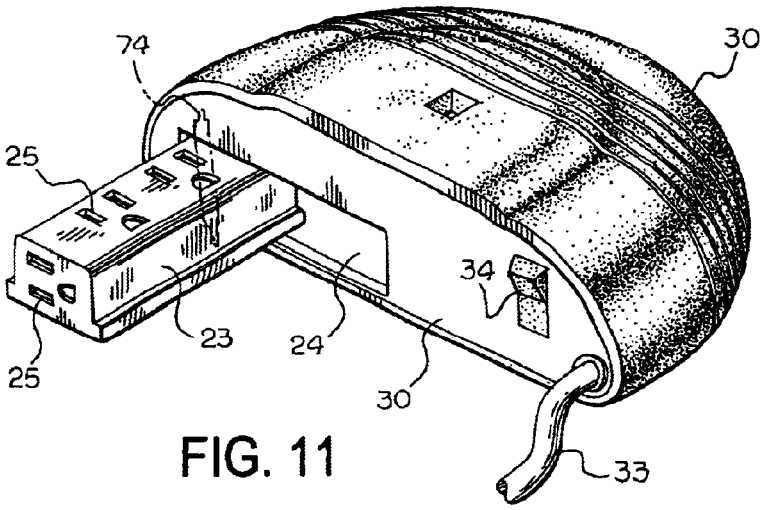
FIG. 11 is a perspective view of a construction embodying the present invention.
Figure 12:
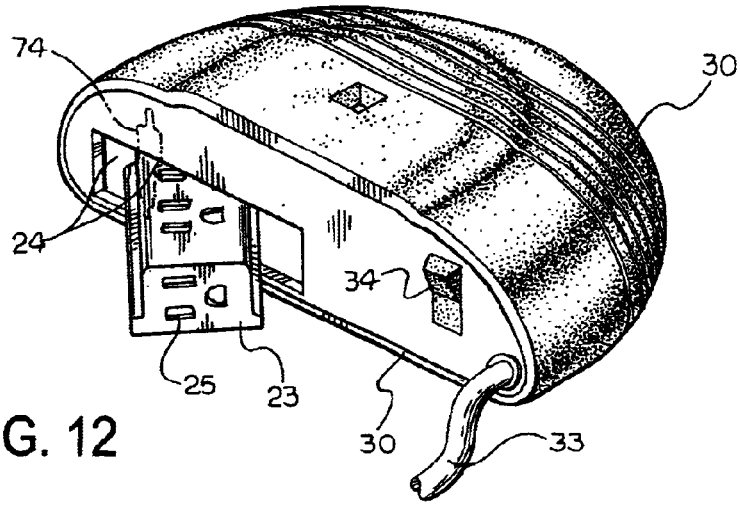
FIG. 12 is a perspective view of an alternative condition of the construction shown in FIG. 11.
Figure 13:
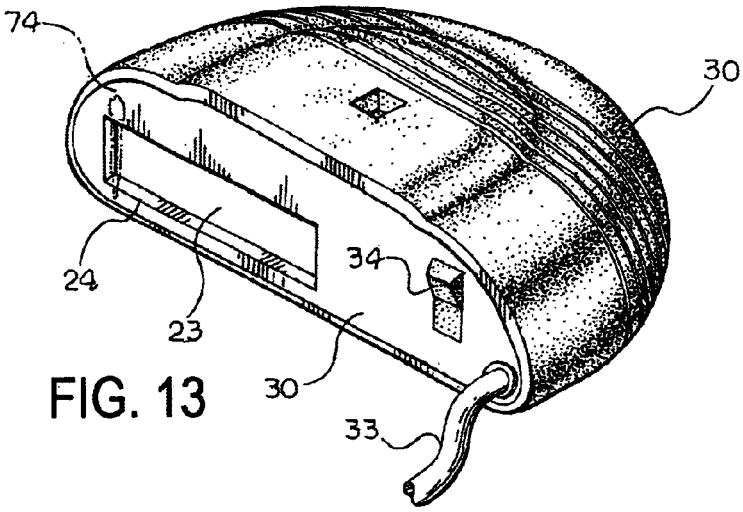
FIG. 13 is a perspective view of an alternative condition of the construction shown in FIG. 11.
Figure 14:
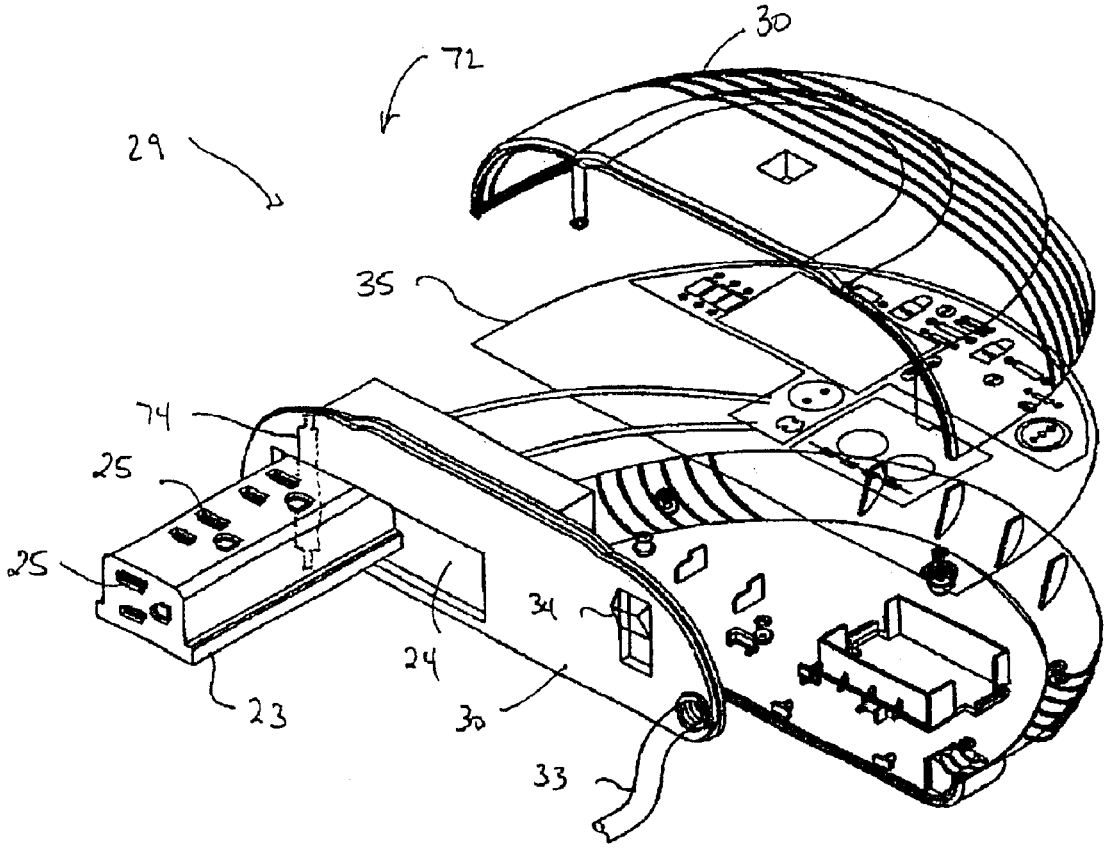
FIG. 14 is an exploded perspective view of the construction shown in FIG. 11.

It should be understood that the present invention may be used for any electronics housing 20. By way of example only, an electronics housing having surge protection located therein will be described. It should also be understood that the present invention is not limited to providing additional line cord outlets, but is broad in scope and is intended to provide additional pop-out outlets or connectors of any kind, such as RJ11 (FIG. 8, 56), RJ45 (FIG. 9, 58) and co-ax (FIG. 10, 60) connectors, needed to protect any type of electrical devices from surges. Such pop-up outlets or connectors are well within the scope of the present invention.

By way of the present example, surge protector housing 22, has at least one extendable housing portion 23, which slides in and out of an opening, 24, provided on the housing, 22. A further plurality of electrical outlets or connectors 25 are formed in the top planar surface of the extendable housing portion 23 and may be of any desired type or number. Preferably, at least one electrical connector 25 is exposed when the extendable housing portion 23 is retracted into the housing such as in the embodiment depicted in FIGS. 2 and 3.

Figure 6A:
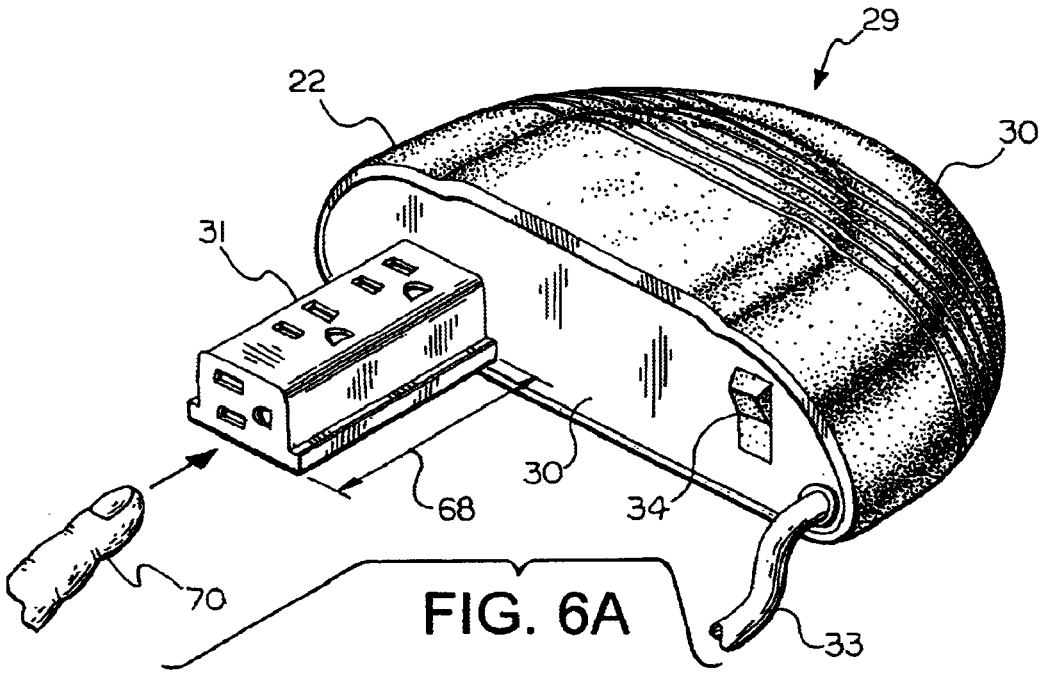
FIG. 6A is a perspective view of a construction embodying the present invention.
Figure 6B:
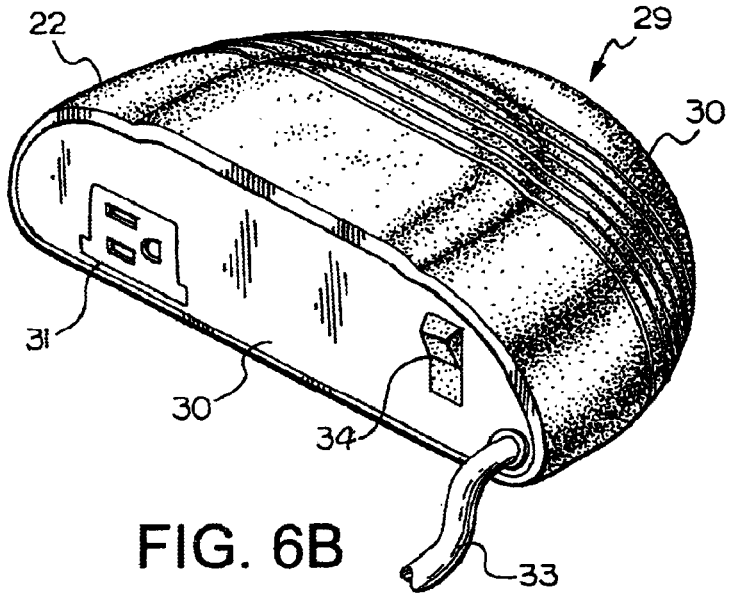
FIG. 6B is a perspective view of an alternative condition of the construction shown in FIG. 6A.
Figure 7:
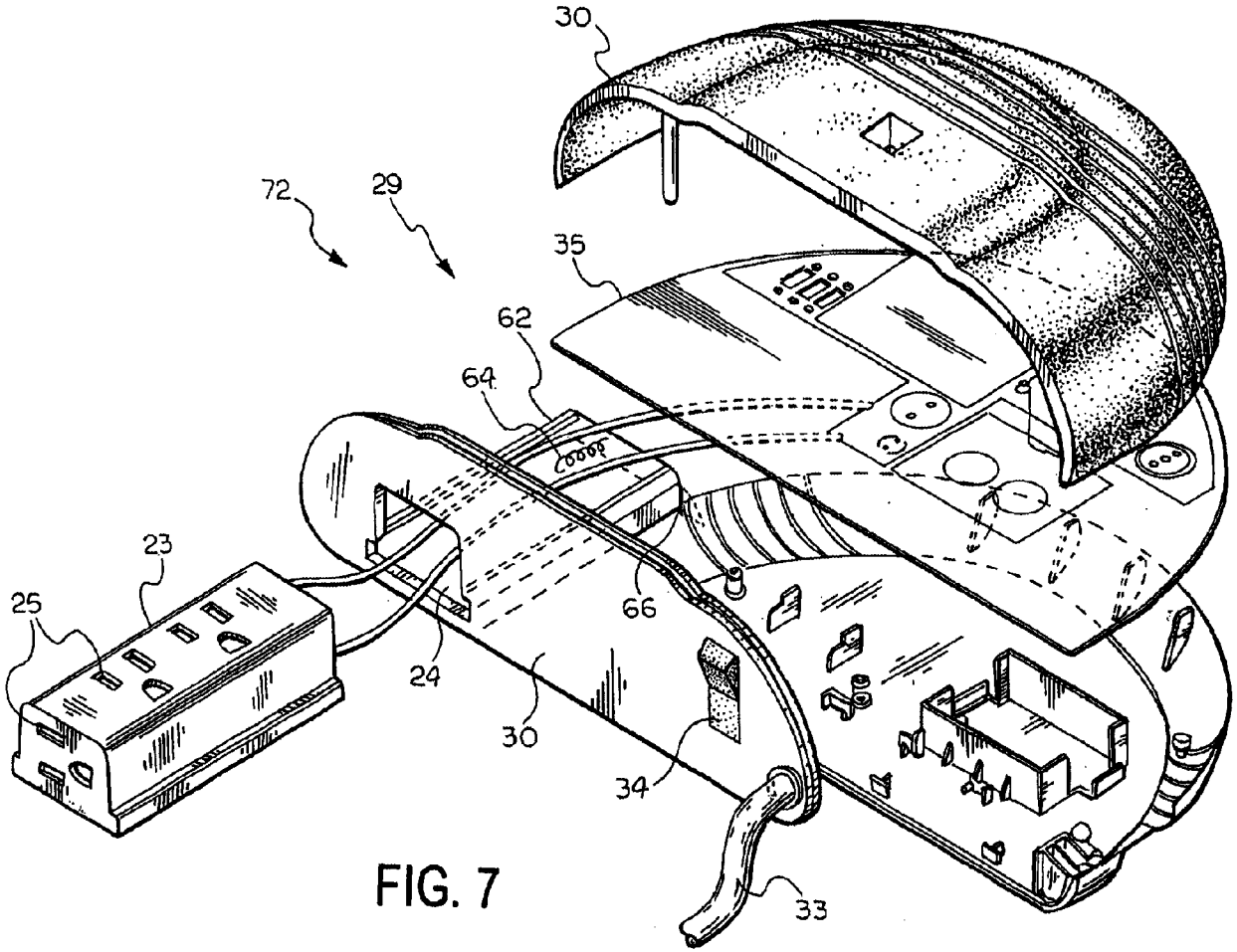
FIG. 7 is an exploded perspective view of the construction shown in FIG. 6A.
Figure 7A:
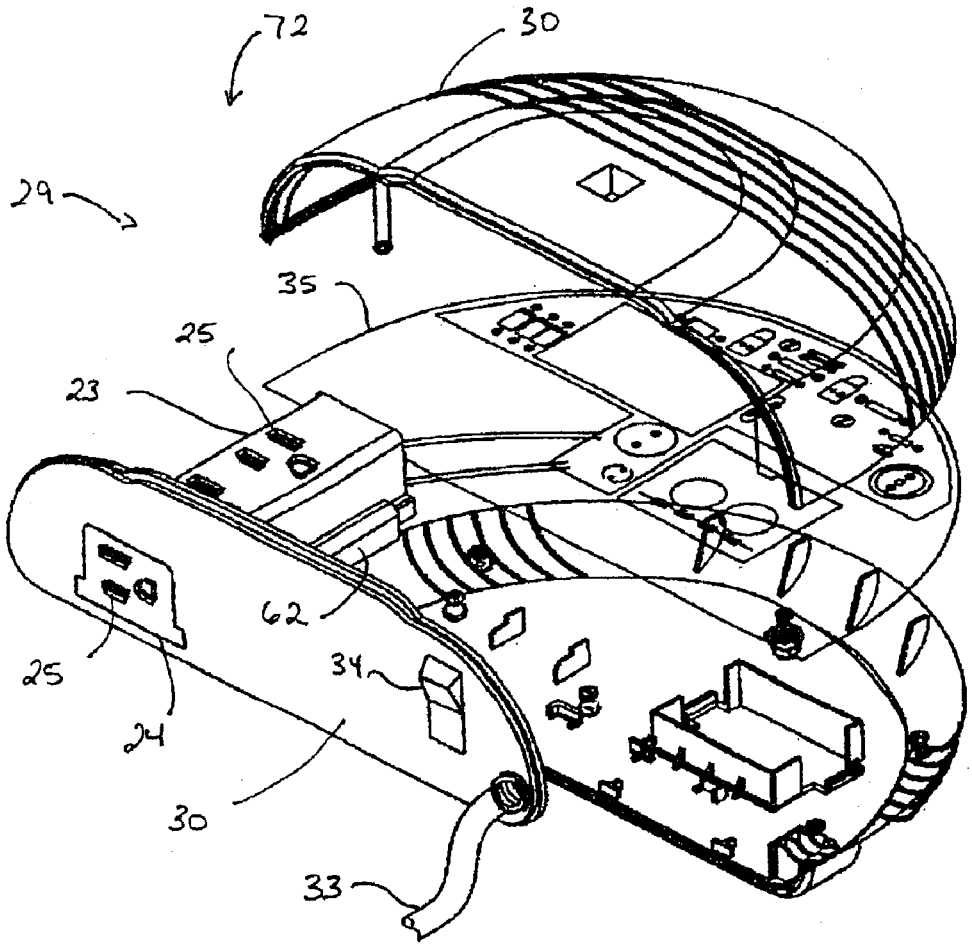
FIG. 7A is an exploded perspective view of an alternative condition of the construction shown in FIG. 7.

As depicted in FIGS. 6A, 6B, 7 and 7A, the extendable housing portion 23 may slide in and out on rails 62 provided in the housing 22 by means well known in the art, and may have a spring loaded pop-out feature 64, or may simply be extended and retracted like a common drawer in the housing 22. The housing 22 has at least one stop 66 in mechanical communication with the housing 22 to prevent the extendable housing portion 23 from extending beyond a predetermined distance from the housing 22 as shown in FIGS. 6A and 7. Preferably, manual means 70 are used to locate the extendable housing portion 23 back into the housing 22. As depicted in FIGS. 6B and 7A, at least one outlet or connector 25 is preferably accessible when the extendable housing portion 23 is retracted in the housing 22, however, embodiments where the outlet or connector 25 is not accessible are also well within the scope of the invention.

Figure 4:
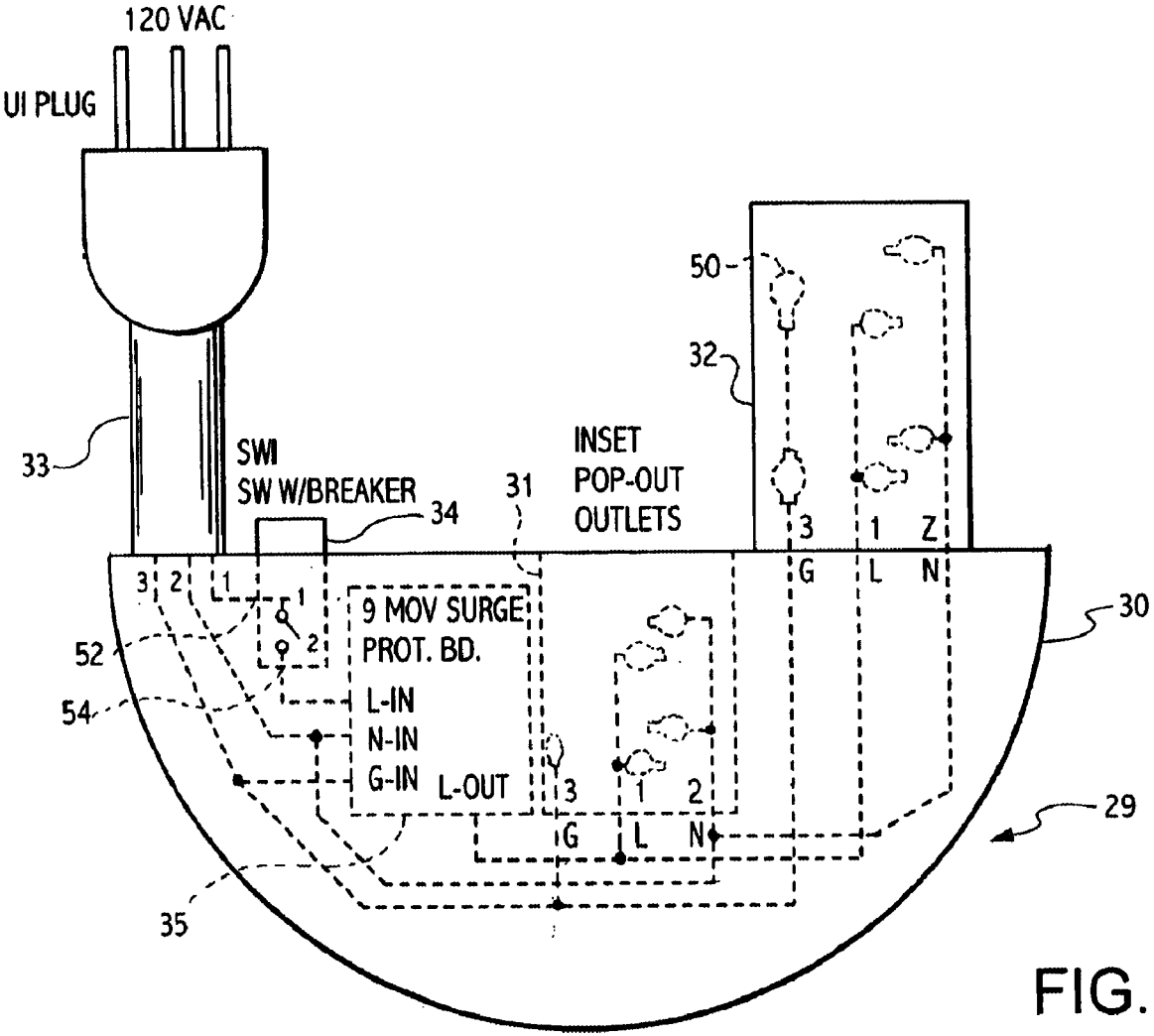
FIG. 4 is a diagrammatic view of the construction shown in FIG. 2.
Figure 5:
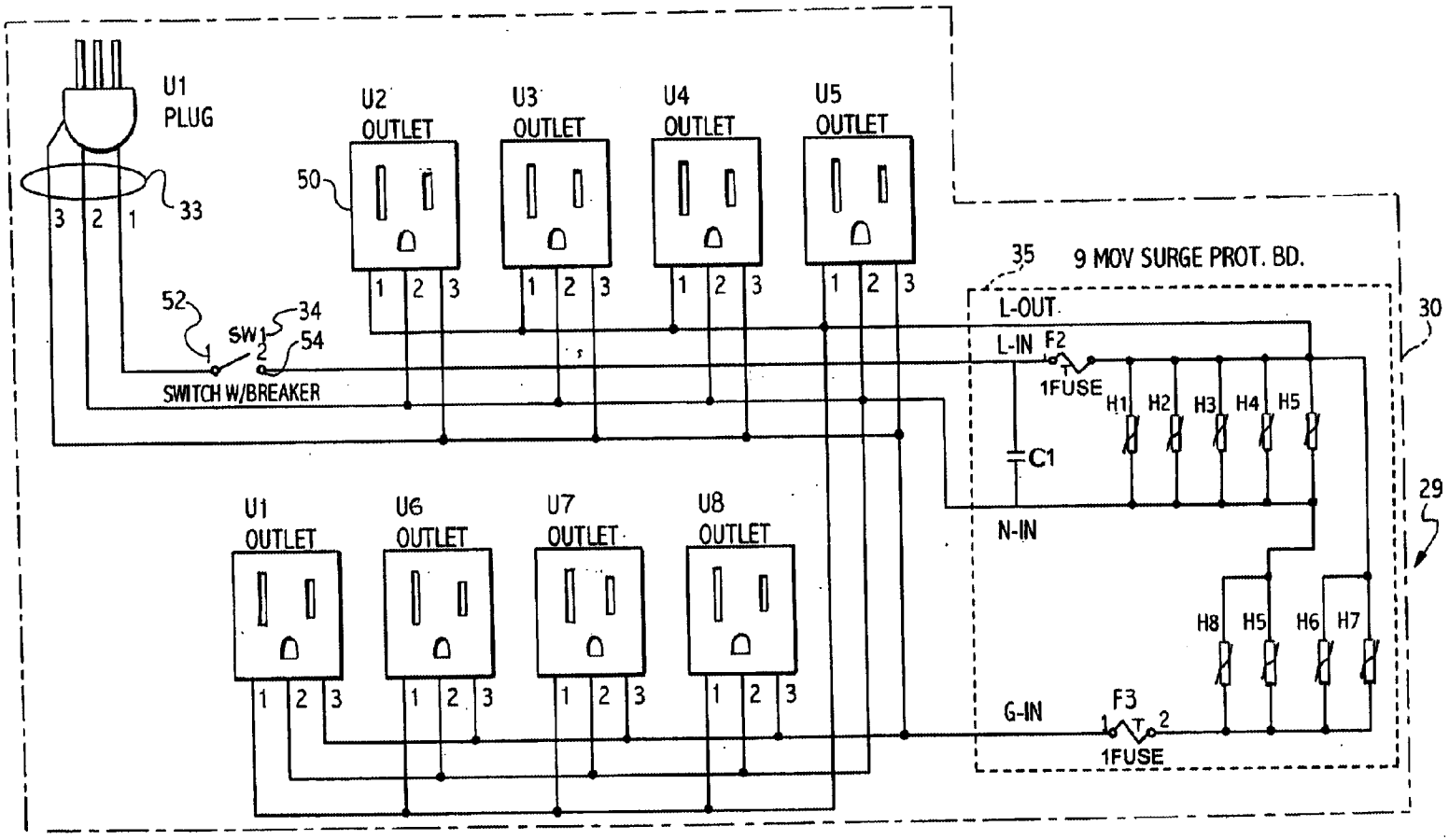
FIG. 5 is an electrical schematic showing the electrical connections for the construction shown in FIG. 4.

Suitable electrical connections as depicted in FIGS. 4 and 5, also well known in the art, are provided in the housing to connect the outlets or connectors 25 to surge protection circuitry 35 which may be provided in the housing 22, and, in turn, to the line cord, 21.

Figure 2:
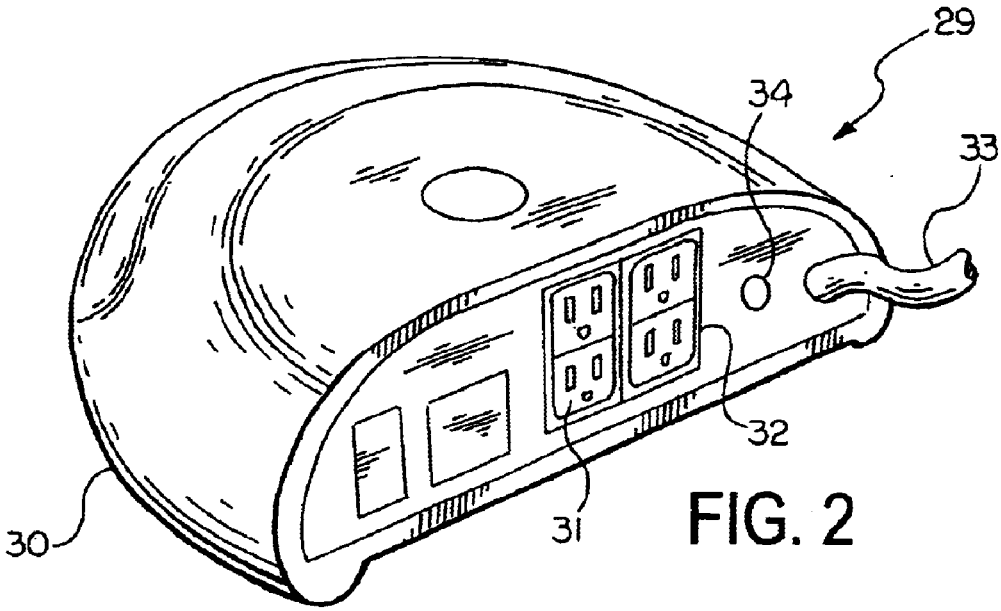
FIG. 2 is a perspective view of a modification of the present invention showing two pop out outlets, both in their retracted position.
Figure 3:
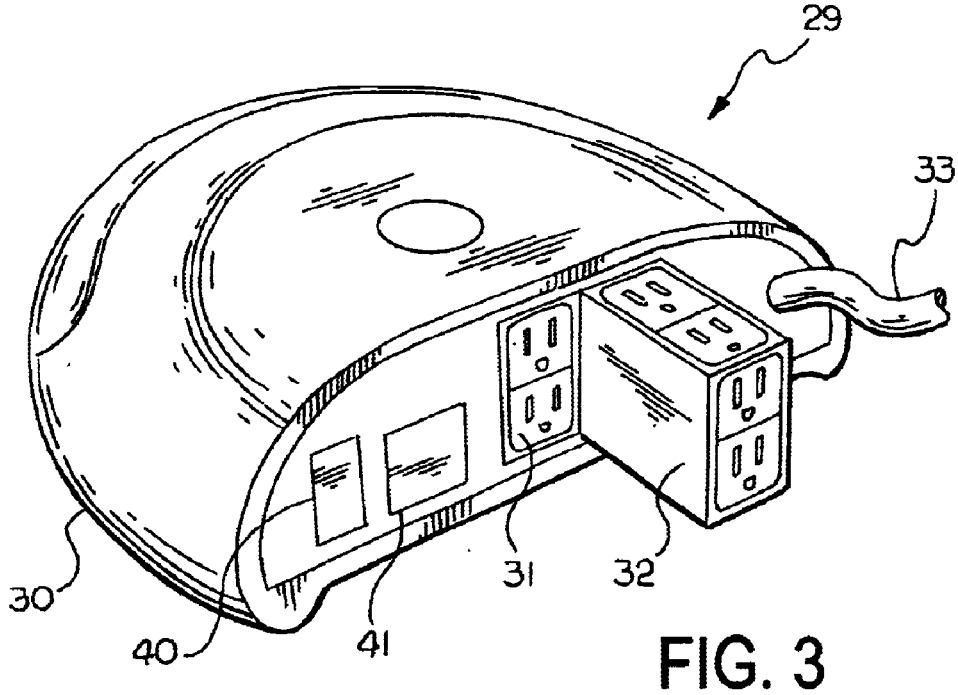
FIG. 3 is a perspective view of the construction shown in FIG. 3 with one of the pop out outlets or connectors shown in its extended or popped out position.

As an example of the wide range of surge protection devices which are within the scope of the present invention, there is shown in FIG. 2 and FIG. 3 a perspective view of a base unit for a stackable USB hub 72, which may be such as shown in applicants co-pending application Ser. No. 60/169,055, which is incorporated herein by reference.

The base unit 29 has a housing, 30, a first pop out outlet, 31, and a second pop out outlet, 32. A line cord, 33, provides power to the device and is connected through on off switch, 34, to the surge protection device, 35 (FIGS. 4 and 5). Additional snap-in or slide in modules may be provided in openings (40, 41) if desired.

The surge protection device 35 protects ground and/or the hot and neutral connectors.

Referring now to FIG. 4 there is shown a diagrammatic view of the base unit 29, which comprises a housing 30, an electrical power cord 33, a power on/off switch with breaker 34, a surge protector board 35, two pop-out outlet modules 31 and 32, and the associated wiring.

To operate, the base unit 29 receives power from the attached power cord 33, which is connected to a 120 volt alternating current power source. Internally, the hot signal is connected to the input connection 52 of the power switch 34, which allows the user to turn power on or off to the base unit 29. From this point on the incoming neutral and ground signals, along with the hot signal from the power switch 34 output connection 54, are connected to the surge protector board 35, and then passed on to the two pop-out outlet modules 31,32.

To protect external electrical equipment from power surges, a user could connect a power cord from the external electrical equipment into a pop-out power outlet, for example, 50. If a surge is detected in the wiring, the surge protector board 35 will direct that surge to ground before the surge can damage the external equipment.

Next referring to FIG. 5, there is shown the electrical schematic of the base unit 29. Power enters the base unit through power cord 33. The hot signal is wired to the input connection 52 of the power switch 34. Then the incoming neutral and ground signals, along with the hot signal of the output connection 54 of the power switch 34, are passed onto the pop-out outlets 31,32, and the surge protector board 35. To use the present invention a user could connect external electrical equipment into a pop-out power outlet, for example, 50. If a surge is detected in the wiring, the surge protector board 35 will direct that surge to ground before the surge can damage the external equipment.

FIGS. 11–14 depict an alternative embodiment of the present invention wherein the extendable housing portion 23, as described above, swings or rotates into and out of the housing on at least one hinge 74. The extendable housing portion 23 may be hinged on either end to allow the housing portion 23 to swing out from either side of the opening 24. Additionally, although the extendable housing portion 23 is depicted as swinging out in a substantially horizontal fashion, it is well within the scope of the invention to allow the extendable housing portion 23 to be hinged at either its top or bottom. Hinges at the top or bottom of the extendable housing portion 22 allow it to swing into and out of the housing along a substantially vertical plane. The extendable housing portion 23 may have at least one outlet or connector 25 accessible when the extendable housing portion 23 is located within the housing 22.

Manual or automated means may be used to extend the extendable housing portion into and out of the housing.

Thus by carefully studying the problems existing in present day electrical devices a novel method and apparatus is provided for providing additional electrical connectors or outlets.

I claim:

1. An electronics housing device, comprising:

a portable housing including a line cord for connection to a source of electrical power and enclosing electrical circuitry;

at least one extendible housing portion selectively moveable both into and out of said housing;

at least one electrical connector on said extendable housing portion, said connector being electrically connected to said electrical circuitry;

said housing and said extendable housing portion having complimentary rails to guide said extendable housing portion into and out of said housing.

2. The device of claim 1, wherein said at least one electrical connector is a three-prong outlet.

3. The device of claim 1, wherein said at least one electrical connector is connected to hot, live and neutral.

4. The device of claim 1, wherein said at least one electrical connector is an RJ11 connector.

5. The device of claim 1, wherein said at least one electrical connector is an RJ45 connector.

6. The device of claim 1, wherein said at least one electrical connector is a co-ax connector.

7. The device of claim 1, wherein said housing has an opening for receiving said extendable housing portion.

8. The device of claim 1, wherein said housing has a stop to prevent said extendable housing portion from extending beyond a predetermined distance from said housing.

9. The device of claim 1, wherein said extendable housing portion is urged from said housing with at least one spring.

10. The device of claim 1, wherein said at least one electrical connector is a three-prong outlet connected to hot, live and neutral conductors of said line cord.

11. The device of claim 1, wherein said housing electrical connector is connected to surge protection within said housing.

12. The device of claim 1, wherein said electrical connectors are connected to surge protection within said extendable housing portion.

13. The device of claim 1, wherein said electrical connectors are connected to surge protection within said housing.

14. The device of claim 1, wherein said at least one electrical connector on said extendable housing portion is accessible when said extendable housing portion is retracted into said housing.

15. The device of claim 1, wherein said extendable housing portion is refracted substantially into said housing.

16. The device of claim 1, wherein said housing has at least one housing electrical connector thereon.

17. The device of claim 16, wherein said at least one housing electrical connector is an RJ11 connector.

18. The device of claim 16, wherein said at least one housing electrical connector is an RJ45 connector.

19. The device of claim 16, wherein said at least one housing electrical connector is a co-ax connector.

20. A method for housing an electronics housing device, comprising:

a) providing a portable housing having a line cord for connection to a source of electrical power and enclosing electrical circuitry;

b) providing at least one extendable housing portion on said housing wherein at least one spring urges said extendable housing portion from said housing; and c) providing at least one electrical connector on said extendable housing portion, the connector being electrically connected to the electrical circuitry.

21. The method of claim 20, wherein said at least one electrical connector is a three-prong connector.

22. The method of claim 21, wherein said at least one electrical connector connected to a source for hot, neutral and ground.

23. The method of claim 20, wherein said electrical connector is a RJ11 connector.

24. The method of claim 20, wherein said electrical connector is an RJ45 connector.

25. The method of claim 20, wherein said electrical connector is a co-ax connector.

26. The method of claim 20, wherein said at least one electrical connector on said extendable housing portion is accessible when said extendable housing portion is retracted into said housing.

27. The method of claim 20, wherein a stop located within said housing prevents said extendable housing portion from extending beyond a predetermined distance.

28. The method of claim 20, wherein said extendable housing portion extends into and out of said housing on a pair of rails.

29. The method of claim 20, wherein said extendable housing portion is urged into maid housing manually.

30. The method of claim 20, wherein said extendable housing portion is retracted substantially within said housing.

31. The method of claim 20, wherein at least one electrical connector is provided on said housing.

32. The method of claim 20, wherein said at least one electrical connector is a three-prong connector.

33. The method of claim 32, wherein said at least one electrical connector is connected to a source for hot, live and neutral.

34. An electronic, housing device, comprising:

a portable stackable hub housing including a line cord for connection to a source of electrical power and enclosing surge protection circuitry;

at least one extendible housing portion selectively moveable both into and out of said housing on at least one rail attached to one of said housing and said housing portion; and at least one electrical connector on said extendable housing portion, said connector being electrically connected to said circuitry.

35. The device of claim 34, wherein said at least one electrical connector is positioned inside said housing when said extendable housing portion is moved into said housing, and including at least one additional electrical connector on one of said housing and said extendible housing portion and being accessible when said extendable housing portion is moved into said housing.

* * * * *